United States Patent [19]

Marmentini et al.

[11] Patent Number: 5,067,417

[45] Date of Patent: Nov. 26, 1991

[54] FOLDABLE LIGHT WEIGHT TABLE

[76] Inventors: Enzo Marmentini; Joyce Marmentini, both of 1382 Ramona Dr., Newbury, Calif. 91320

[21] Appl. No.: 482,856

[22] Filed: Feb. 22, 1990

[51] Int. Cl.[5] ..... A47B 3/00

[52] U.S. Cl. ..... 108/36; 108/130

[58] Field of Search ..... 108/34, 114, 35, 36, 108/130; 312/24, 244; 190/11

[56] References Cited

U.S. PATENT DOCUMENTS

| | | | |
|---|---|---|---|
| 1,325,130 | 12/1919 | Whitacre . | |
| 2,531,778 | 11/1950 | Merner . | |
| 2,673,774 | 3/1954 | Di Prima | 312/201 |
| 2,837,394 | 6/1958 | Rahall . | |
| 2,978,012 | 4/1961 | Norseen . | |
| 3,994,527 | 11/1976 | Nikitits et al. . | |
| 4,005,898 | 2/1977 | Way | 108/130 |

FOREIGN PATENT DOCUMENTS

| | | | |
|---|---|---|---|
| 8700737 | 2/1987 | PCT Int'l Appl. | 108/34 |

*Primary Examiner*—Laurie K. Cranmer
*Assistant Examiner*—Gerald A. Anderson
*Attorney, Agent, or Firm*—Fleit, Jacobson, Cohn, Price, Holman & Stern

[57] ABSTRACT

A foldable table is provided including a pair mirror image half table sections. The half table sections include adjacent margins pivotally joined together for upward swinging of the remote margins of the table sections toward positions with the table half sections in relatively folded closely juxtaposition. The remote margins include outwardly projecting handles as well as downwardly swingable and upwardly retractable leg structures each being adjustable in length and the leg structures include panels extending transversely of the table and upon whose outer surfaces openable and closable pouches are supported. In addition, the table half sections are constructed for manufacture by conventional molding processes.

10 Claims, 2 Drawing Sheets

FOLDABLE LIGHT WEIGHT TABLE

BACKGROUND OF THE INVENTION

1. Field of the Invention

This invention relates to a light weight table which may be folded for compact storage and transport and which is designed primarily for use when caring for infants (changing clothes and diapers, etc.).

2. Description of Related Art

Various different forms of foldable tables and other similar structures heretofore have been provided including some of the general structural and operational features of the instant invention. Examples of these previously known devices are disclosed in U.S. Pat. Nos. 1,325,130, 2,531,778, 2,837,394, 2,978,012 and 3,994,527.

However, these previously known devices do not include the overall combination of structural and operational features provided in the instant invention.

SUMMARY OF THE INVENTION

The light weight table of the instant invention incorporates a pair of table top sections hingedly secured together along adjacent margins for folding into a compact state and remote margins of the table top sections ar provided with hinged legs which are longitudinally extendable and retractable, thereby enabling the table to be used at different heights. Independent adjustment of the length of the legs permits erection of the table in limited spaces and relative to uneven surfaces such as vehicle seats, transport aircraft seats, etc., thus allowing the care of an infant with little effort and independent of a specific position of the operator. In addition, the size of the table is such to accommodate an infant, clothing and other supplies which may be needed while changing an infants diaper.

Another aspect of the invention is the fact that the outer sides of the opposite end legs thereof include closable pouches for containing clothing and supplies and yet another, and perhaps more important aspect of the invention resides in the fact that the two top half sections of the table are identically formed and include identical simplified hinge constructions.

The main object of this invention is to provide a table which may be collapsed for compact storage and transport.

Another of this invention is to provide a table specifically designed as a supporting unit while changing an infant's diaper or clothing an infant.

Still another object of this invention is to provide a table in accordance with the preceding objects and including foldable, adjustable length opposite end legs in order to enable the top of the table to be disposed at different heights relative to a supporting surface for the legs of the table.

A further object of this invention is to provide a collapsible table with foldable legs and constructed in a manner whereby the foldable legs each include a closable pouch for receiving clothing a baby supplies and with the closable pouches disposed to the exterior sides of the table when the table is collapsed.

A still further object of this invention is to provide a collapsible table of the type including relatively pivotal table half sections and wherein each of the table half sections is identically formed and constructed in a manner whereby the table may be manufactured at low cost through the utilization of conventional molding processes.

A final object of this invention to be specifically enumerated herein is to provide a folding table in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

Figure 3:
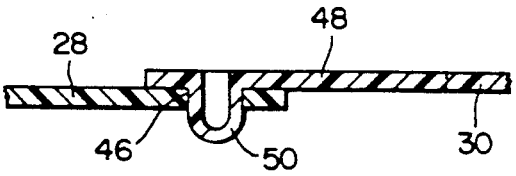
FIG. 3 is an enlarged fragmentary horizontal sectional view taken substantially upon the plane indicated by the section line 3—3 of FIG. 2 and illustrating one of the latch mechanisms which releasably retain two half sections of the table in an extended position.

FIG. *3a* is an enlarged fragmentary horizontal sectional similar to FIG. 3 but illustrating the latch mechanism in a release position.

Figure 2:
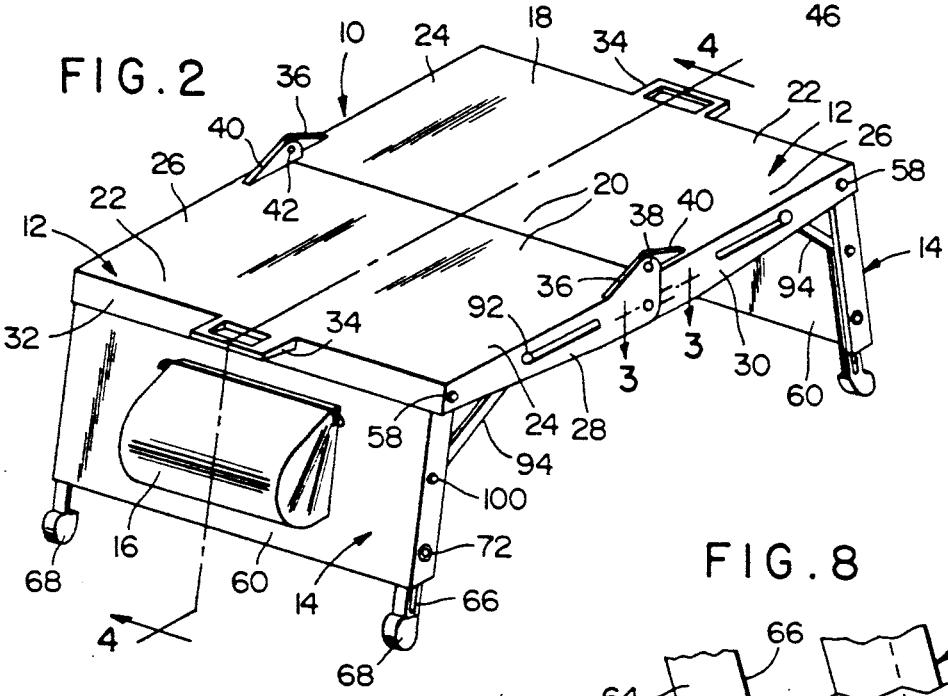
FIG. 2 is a perspective of the table in a fully extended position.
Figure 8:
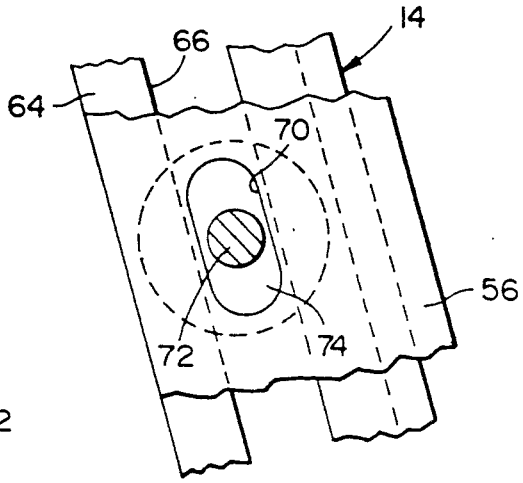
Figure 9:
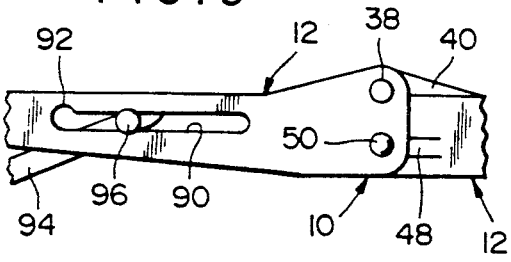
Figures 4, 5, 5A, 6, 7:
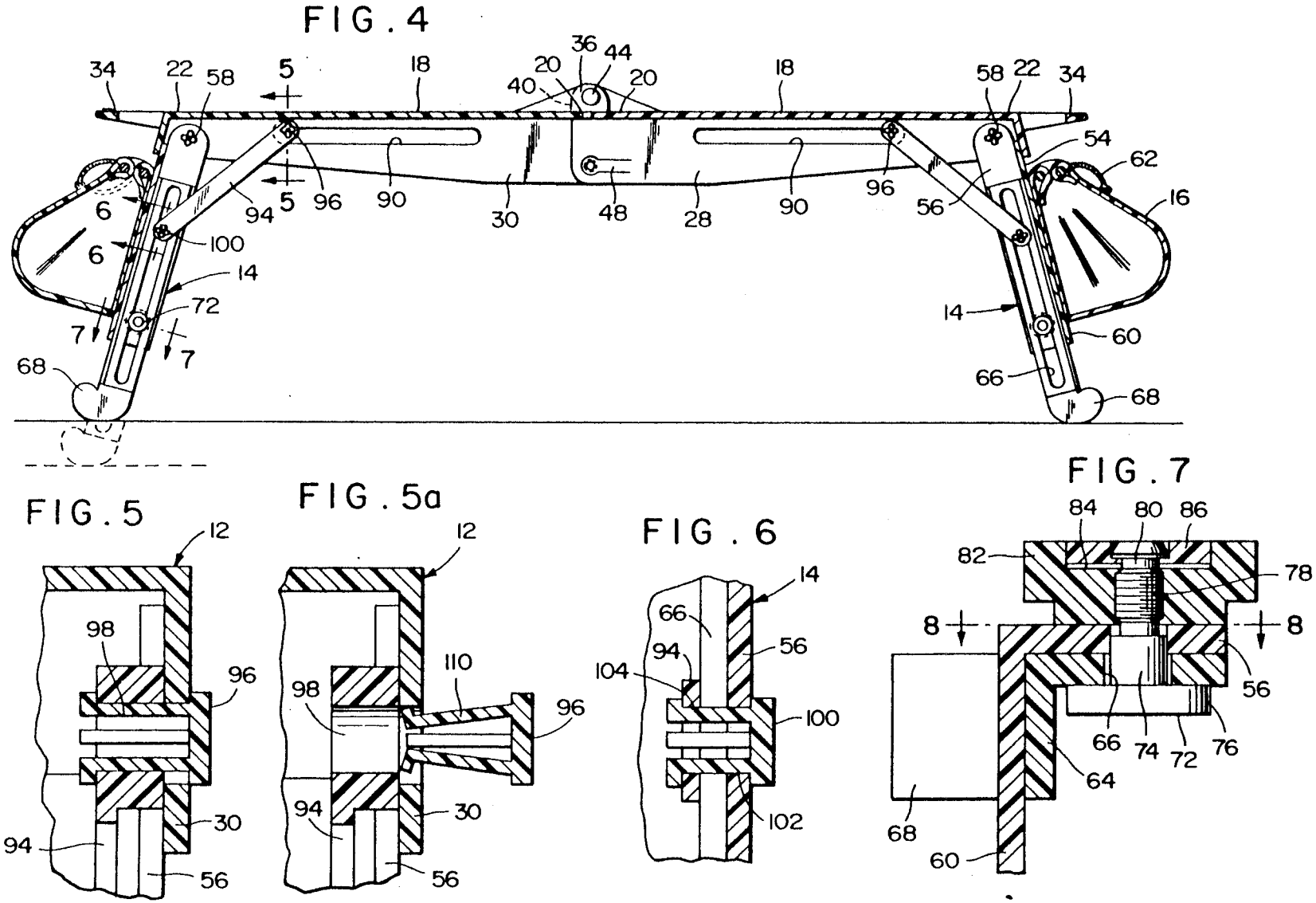

FIG. 4 is an enlarged fragmentary vertical sectional view taken substantially upon the plane indicated by the section line 4—4 of FIG. 2;

FIG. 5 is an enlarged fragmentary transverse vertical sectional view taken substantially upon the plane indicated by the section line 5—5 of FIG. 4 and illustrating the sliding pivot for the diagonal brace of the associated pivoted table legs;

FIG. *5a* is an enlarged fragmentary transverse vertical sectional view similar to FIG. 5 but illustrating the pivot fastener between the diagonal brace and the associated table half section in position immediately prior to assembly;

FIG. 6 is an enlarged fragmentary vertical sectional view taken substantially upon the plane indicated by the section line 6—6 of FIG. 4;

FIG. 7 is an enlarged fragmentary horizontal sectional view taken substantially upon the plane indicated by the section line 7—7 of FIG. 4;

FIG. 8 is a fragmentary vertical sectional view taken substantially upon the plane indicated by the section line 8—8 of FIG. 7; and FIG. 9 comprises a fragmentary side elevational view of the central portion of the table with the left hand brace 94 illustrated in position with the corresponding leg assembly 14 in a partially collapsed position.

DESCRIPTION OF THE PREFERRED EMBODIMENT

Referring now more specifically to the drawings the numeral 10 generally designates the foldably collapsible table of the instant invention. The table 10 includes a pair of identical table half sections referred to in general by the reference numerals 12. Each half section 12 includes a pivotally foldable and extendable leg assembly referred to in general by the reference numeral 14 and each leg assembly 14 includes an openable and closable flexible storage pouch 16 supported therefrom.

Each half section 12 further includes a planar top 18 and the planar tops 18 include adjacent and remote margins 20 and 22 as well as opposite side margins 24 and 26.

The margins 24 include downwardly directed flanges 28 extending therealong and the margins 26 include downwardly directed flanges 30 extending therealong. Also, the margins 22 include downwardly directed flanges 32 as well as central outwardly projecting bail type handles 34.

Each of the flanges 28, adjacent the corresponding margin 20 includes an upward extension or mounting ear 36 apertured as at 38 and each planar top 18 includes an upward projection or mounting ear 40 adjacent the end of the corresponding margin 20 which intersects with the corresponding flange 30, the projection 40 being spaced inward from the corresponding flange 30. The extensions 36 and pro 40 project slightly outwardly of the corresponding margins and each extension 36 is flush with the corresponding flange 28 while each projection is inwardly offset from the corresponding flange 30 whereby each extension 36 lengthwise and laterally overlaps the corresponding projection 40, the latter being apertured as at 42. Each pair of apertures 38 and 42 are registered with each other and a pivot fastener 44, similar to 96 and 100 illustrated in FIGS. 5, 5*a* and FIG. 6 and described hereinafter, extends through each pair of registered apertures 38 and 42, whereby the half sections 12 are pivotally joined together for relative swinging between the collapsed positions thereof illustrated in FIG. 1 and the extended positions thereof illustrated in FIG. 2.

Figure 3A:
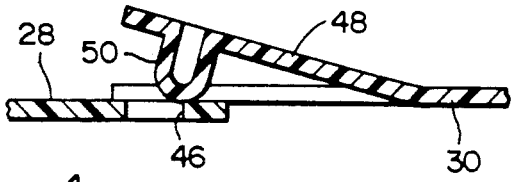

It will be noted that the pivot fasteners 44 are spaced above the planar tops 18 and that the flanges 28 and 30 extend considerably below the planar tops 18 with the flanges 28 having apertures 46 formed therethrough and the flanges 30 including resilient tongue portions 48 formed integrally therewith and including cylindrical integral projections 50 on their free ends receivable through the apertures 46, see FIGS. 3 and 3*a*. When the projections 50 are received through the apertures 46, the half sections 12 are releasably latched in the extended co-planar positions thereof illustrated in FIG. 2. Also, it is to be noted that the two half sections 12 are identically formed and that they may be made from the same mold. Of course, when it is desired to fold the half sections 12 relative to each other in order that the table 10 may assume the collapsed position thereof illustrated FIG. 1, the projections 50 are simultaneously pressed inward from opposite sides of the table 10 to displace the projections 50 from the apertures 46, after which the half sections 12 may be pivoted to their collapsed positions.

Figure 1:
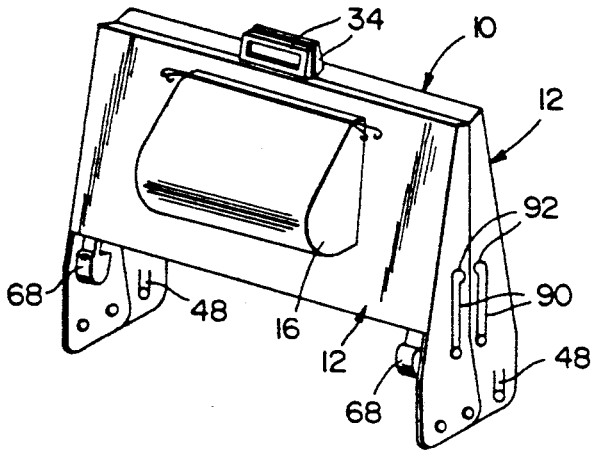
FIG. 1 is a perspective view of a table constructed in accordance with the present invention and with the table in a fully collapsed position.

When the half sections 12 are in the collapsed positions thereof illustrated in FIG. 1, the handles 34 are disposed in close juxtaposed positions and form a single handle by which the collapsed table 10 may be readily carried.

With attention now invited more specifically to FIGS. 4–8, each half section 12 includes a leg assembly 14 and each leg assembly 14 includes an upper leg section 54 comprising a pair of upper section legs 56 pivotally supported as at 58 from the corresponding flanges 28 and 30 and including an interconnecting panel 60 extending therebetween, the panels 60 being formed integrally with the corresponding upper leg sections 56 and supporting, on their outer surfaces, the corresponding pouches 16. Each of the pouches 16 includes a drawstring 62 by which the upper end of the pouch 16 may be selectively closed and each upper section leg 56 defines an inside corner in which and L-shaped lower section leg is slidably received. Each lower section leg 54 includes a elongated longitudinal slot 66 and a lower end foot 68.

Each upper section leg 56 includes an oblong opening 70 formed therein and a headed shank type fastener 72 includes an oblong shoulder 74 thereon received through the corresponding slot 66 and projecting into the corresponding oblong opening 80. The end of the shank of the fastener 72 remote from the head 76 thereof is externally threaded as at 78 and projects fully through the opening 70 and further includes a terminal end provided with a circumferential groove 80. A threaded hand nut 82 is threaded on each fastener 72 and includes an outwardly opening center recess 84 in which a washer 86 is loosely received, the inner periphery of the washer 86 being snap-engaged in the corresponding groove 80. Thus, the hand nuts 82 may not be readily unthreaded from the corresponding fasteners 72 but may be tightened and loosened with respect thereto in order to retain and release, respectively, the lower section legs 64 in adjusted extended positions relative to the corresponding upper leg sections 56.

With attention now more specifically invited to FIGS. 4–6, each flange 28 and 30 is provided with an elongated longitudinally extending slot 90 centrally intermediate its opposite ends and the ends of the slots 90 adjacent the margins 32 include upward projections 92, see FIGS. 1 and 2. The upper end of an inclined brace 94 is pivotally and slidably anchored to each flange 28 and 30 through the utilization of a removable pivot fastener 96 passes through the corresponding slot and an aperture 98 registered therewith formed in the upper end of the brace 94. The lower end of each brace 94 is pivotally attached to the corresponding upper section leg 56 through the utilization of a similar removable pivot fastener 100 and each pivot fastener 100 is inserted through an aperture 102 provided therefore in the corresponding upper section leg 56, through the corresponding slot 66 and through an aperture 104 formed in the lower end of the brace 94. When the fasteners 96 are in the projections 92, the braces 94 are locked in the operative positions thereof bracing the leg assemblies 14 in their unfolded positions. However, when the fasteners 96 are disposed in the adjacent ends of the slots 90, the legs are fully folded into positions within the recesses defined within the boundaries of the corresponding flanges 28, 30 and 32.

As may be seen from FIG. 5*a*, the fasteners 96 incorporate circumferentially extending deflectable tongues 110 which enable the fasteners 96 to be removed and replaced in a manner which is believed obvious from FIG. 5*a*. Further, the pivot fasteners 44 may comprise fasteners similar to the fasteners 96 and 100 and the fasteners as at 58 also may comprise fasteners corresponding the fasteners 96 and 100.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A foldable light weight table including a pair generally horizontal table top half sections including generally co-planar upper surfaces, adjacent and remote margins and opposite side margins extending between said adjacent and remote margins, said remote margins each including downwardly extendible and upwardly retractable leg means, said adjacent margins each, at each of the ends thereof adjacent the corresponding side margins, including a mounting ear disposed generally normal to said adjacent margins and projecting upward above the corresponding upper surface and outwardly beyond the corresponding adjacent margin with the mounting ears of each half section being laterally overlapped relative to the mounting ears of the other half section, and pivot means pivotally interconnecting the overlapped portions of said mounting ears adjacent each pair of corresponding side margins for upward swinging of said remote margins relative to said adjacent margins and movement of said half sections into closely opposing, parallel collapsed positions, said leg means including upper and lower ends and said upper ends being pivotally mounted from said remote margins for upward swinging retraction of the lower ends of said legs toward the corresponding adjacent margins of said table half sections, said table top half sections defining downwardly opening cavities into which said leg means are at least substantially upwardly retractable, said leg means each including upper and lower sections thereof, said lower sections being adjustably extendible and retractable relative to said upper sections, inclined brace means pivotally attached at their lower ends to said upper sections and slidably attached to said side margins for movement therealong at their upper ends, said side margins and upper ends including means operative to releasably anchor said upper ends in positions defining limit positions of movement along said side margins toward said remote margins.

2. The table of claim 1 wherein said adjacent margins include co-acting releasable latch means for retaining said half sections in positions with said upper surfaces generally co-planar.

3. The table of claim 1 wherein said half sections comprise substantial mirror images of each other and the mounting ears of one section laterally overlap the mounting ears of the other section on the same sides thereof.

4. The table of claim 1 wherein said remote margins include handles projecting outwardly therefrom closely registered with each when said half sections are in said closely opposing, parallel collapsed positions.

5. A foldable light weight table including a pair generally horizontal table top half sections including generally co-planar upper surfaces, adjacent and remote margins and opposite side margins extending between said adjacent and remote margins, said remote margins each including downwardly extendible and upwardly retractable leg means, said adjacent margins each, at each of the ends thereof adjacent the corresponding side margins, including a mounting ear disposed generally normal to said adjacent margins and projecting upward above the corresponding upper surface and outwardly beyond the corresponding adjacent margin with the mounting ears of each half section being laterally overlapped relative to the mounting ears of the other half section, pivot means pivotally interconnecting the overlapped portions of said mounting ears adjacent each pair of corresponding side margins for upward swinging of said remote margins relative to said adjacent margins and movement of said half sections into closely opposing, parallel collapsed positions, said leg means including upper and lower ends and said upper ends being pivotally mounted from said remote margins for upward swinging retraction of the lower ends of said legs toward the corresponding adjacent margins of said table half sections, said table top half sections defining downwardly opening cavities into which said leg means are at least substantially upwardly retractable, said leg means each including upper and lower sections thereof, said lower sections being adjustably extendible and retractable relative to said upper sections, said upper and lower sections including nested and slidably engaged elongated angle member sections extending longitudinally therealong, said lower sections each including a longitudinal slot therein, said upper sections each including an oblong opening formed therein, registered with and extending longitudinally of the corresponding slot, a headed shank inserted through each of said slots and opening and including an oblong enlargement thereon adjacent the head thereof slidably received through the corresponding slot and projecting into the corresponding opening, the end of said shank remote from said head projecting outwardly of the end of the corresponding opening remote from said slot and having a threaded clamped nut threadingly engaged thereon.

6. The table of claim 5 wherein the end of each nut facing outward of the corresponding upper section includes an outwardly opening recess formed therein, the last mentioned end of each shank including a terminal end having an abutment rotatably mounted thereon and axially closely received in said recess.

7. The table of claim 6 including inclined brace means pivotally attached at their lower ends to said upper sections and slidably attached to said side margins for movement therealong at their upper ends, said side margins and upper ends including means operative to releasably anchor said upper ends in positions defining limit positions of movement along said side margins toward said remote margins.

8. The table of claim 7 wherein said half sections comprise substantial mirror images of each other and the mounting ears of one section laterally overlap the mounting ears of the other section on the same sides thereof.

9. The combination of claim 8 wherein said remote margins include handles projecting outwardly therefrom closely registered with each when said half sections are in said closely opposing, parallel collapsed positions.

10. The table of claim 5 wherein each of said leg means upper sections extends along substantially the full length of the corresponding remote margin and the remote sides of said upper sections include article receiving pouch structure supported therefrom.

* * * * *